United States Patent [19]

Armstrong

[11] Patent Number: 4,795,181

[45] Date of Patent: Jan. 3, 1989

[54] SKATEBOARD

[76] Inventor: Robert B. Armstrong, 2624 Hounds Chase, Troy, Mich. 48098

[21] Appl. No.: 177,263

[22] Filed: Apr. 4, 1988

[51] Int. Cl.[4] ..... A63C 17/04

[52] U.S. Cl. ..... 280/87.04 A; D21/227

[58] Field of Search ..... 280/87.04 R, 87.04 A, 280/11.1 R, 11.1 BT, 11.2, 11.27, 11.28; D21/227

[56] References Cited

U.S. PATENT DOCUMENTS

| | | | |
|---|---|---|---|
| 1,701,410 | 2/1929 | Hornquist | 280/87.04 R |
| 3,252,713 | 5/1966 | Heller | 280/87.04 A |
| 3,512,798 | 5/1970 | Siegel | 280/87.04 A |
| 3,630,540 | 12/1971 | Smith | 280/87.04 A |
| 4,043,566 | 8/1977 | Johnson | 280/87.04 A |
| 4,095,817 | 6/1978 | Cohen | 280/87.04 A |
| 4,106,786 | 8/1978 | Talbott | 280/87.04 A |
| 4,133,548 | 1/1979 | Smith | 280/87.04 R |

FOREIGN PATENT DOCUMENTS 576729 4/1946 United Kingdom .

OTHER PUBLICATIONS

Wheelee Board, Skateboarder Magazine, Sep. 1977, vol. 4.

*Primary Examiner*—David M. Mitchell
*Assistant Examiner*—Richard Camby
*Attorney, Agent, or Firm*—Cullen, Sloman, Cantor, Grauer, Scott & Rutherford

[57] ABSTRACT

A skateboard comprises a single oversized centrally-located wheel in addition to conventional pairs of front and rear wheels. The wheels are arranged so that the board will ride on no more than three wheels at a time, with either the front or rear pair being elevated above the supporting ground surface, depending upon the rider's longitudinal weight distribution on the skateboard relative to the center wheel. An optional foot-operated friction brake is engageable with the center wheel.

5 Claims, 1 Drawing Sheet

SKATEBOARD

BACKGROUND OF THE INVENTION

This invention relates to improvements in skateboards, a popular entertainment product among young people.

Skateboards generally comprise a four-wheeled platform about two-and-a-half feet in length, the geometry of which lends itself to great maneuverability and even acrobatics when used by accomplished riders. Typically, there is a front and rear axle, each rotatably supporting a pair of low friction wheels laterally spaced a distance of six to eight inches. The axles may be mounted in a way to be slightly steerable, so that when the rider's weight is shifted laterally, the orientation of the axle may shift slightly to produce a desired steering effect. Furthermore, the platform may extend longitudinally beyond the front and rear axles, so that the overhanging portion, if weighted by the rider, can cause the wheels at the opposite end of the skateboard to lift off the ground. When this occurs, coupled with appropriate balancing and movement of the rider's feet, the skateborad can be made to pivot laterally about the wheels which remain in contact with the ground, thereby providing a desired steering action or even a complete reversal of board orientation while still traveling in the same direction.

The object of the present invention is to provide a modified skateboard which substantially increases the degree of maneuverability and the number of riding modes and types of actions that a skilled rider can perform on the board.

SUMMARY OF THE INVENTION

The improved skateboard is characterized by an additional fifth wheel located approximately in the center of the board. Preferably, the front and rear ends of the platform portion of the board are at a higher elevation than the central portion of the platform, so that the elevation of the front and rear axles precludes all five wheels from being in contact with the ground simultaneously. Therefore, depending upon the weight distribution of the rider, the skateborad will roll on either the two front wheels and the center wheel, with the rear wheels being out of contact with the ground, or alternatively, on the center and two rear wheels, with the two front wheels being elevated out of contact with the ground. With sufficient speed and balance, a rider may be able to roll on the just the single center wheel, providing maximum challenge and maneuverability. Furthermore, a friction brake is provided for selective engagement with the center wheel, thereby permitting additional options in maneuvering.

DETAILED DESCRIPTION OF THE INVENTION

Figure 1:
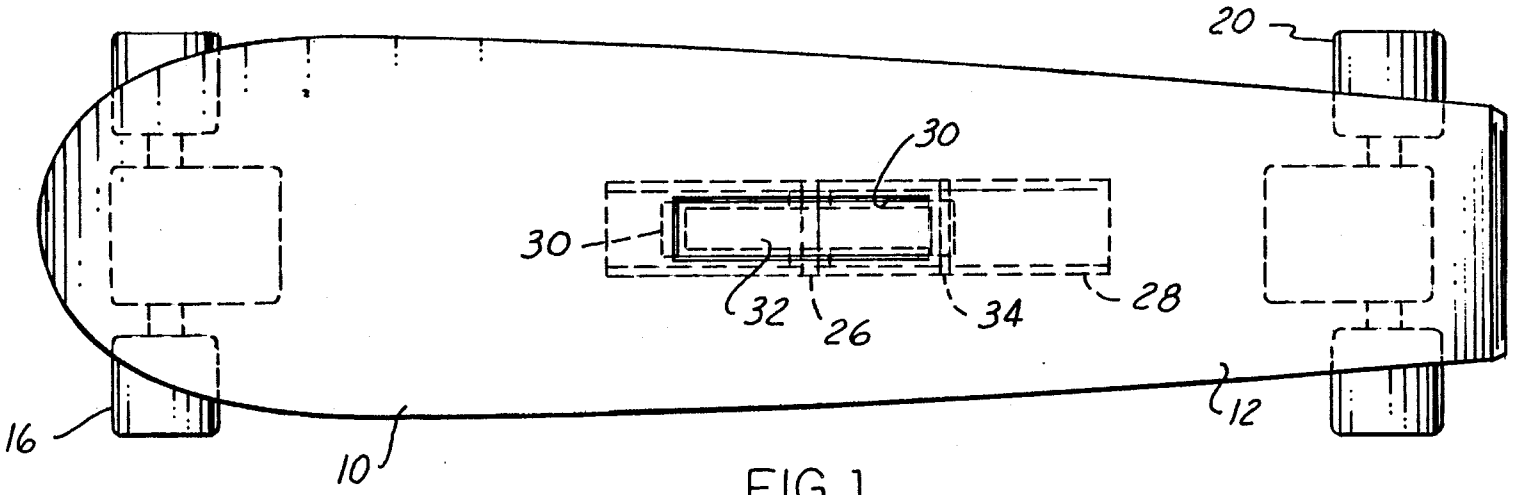
FIG. 1 is a plan view of the skateboard of the present invention, showing the wheels in dotted lines.

Referring to the drawings, the improved skateboard generally comprises front and rear platform portions 10, 12, respectively. A front axle assembly 14 is mounted beneath front portion 10 and carries a pair of laterally spaced front wheels 16. This axle assembly is of conventional design, providing a limited amount of steering when the rider's weight is shifted laterally. A similar rear axle assembly 18 is mounted beneath the rear platform portion 12 and carries a pair of laterally spaced rear wheels 20.

A central single-wheel assembly 22 comprises a center wheel 24 rotatably mounted on a fixed center axle 26 which is secured to a pair of laterally spaced structural rib-like flanges 28 which are secured to the underside of the board platform in any suitable fashion. For example, flanges 28 may form part of an inverted channel-shaped member, which provides desired rigidity and can be readily fastened to the platform. A central slot 30 is provided in the platform to receive the large diameter center wheel 24. The center wheel preferably has a relatively large diameter, such as six inches, to increase the ability to traverse pavement bumps and cracks, curbs, or to roll on softer riding surfaces such as grass or dirt.

As an optional feature, a friction brake may be provided for the center wheel. In the form shown, the brake provides a fender-like brake shoe or enclosure 32 which is closely spaced from the sides and perimeter of the upwardly-extending portion of center wheel 24. Shoe 32 is pivoted on a traverse pin 34 which extends between flanges 28. A lip 36 at the forward end of shoe 32 is positioned to engage the forward edge of slot 30, thereby limiting the upward movement of the shoe away from the center wheel. Resilient means (not shown), such as a resilient pad, coil or torsional spring, can be provided to normally maintain shoe 32 out of engagement with wheel 24. To activate the brake, all that the rider need do is step on the upwardly-projecting portion of the shoe with one foot, applying sufficient weight to achieve the desired degree of frictional braking.

As will be understood by those skilled in the art, other brake configurations can be employed if desired, the illustrated form being illustrative of one convenient and effective form of construction.

Figure 2:
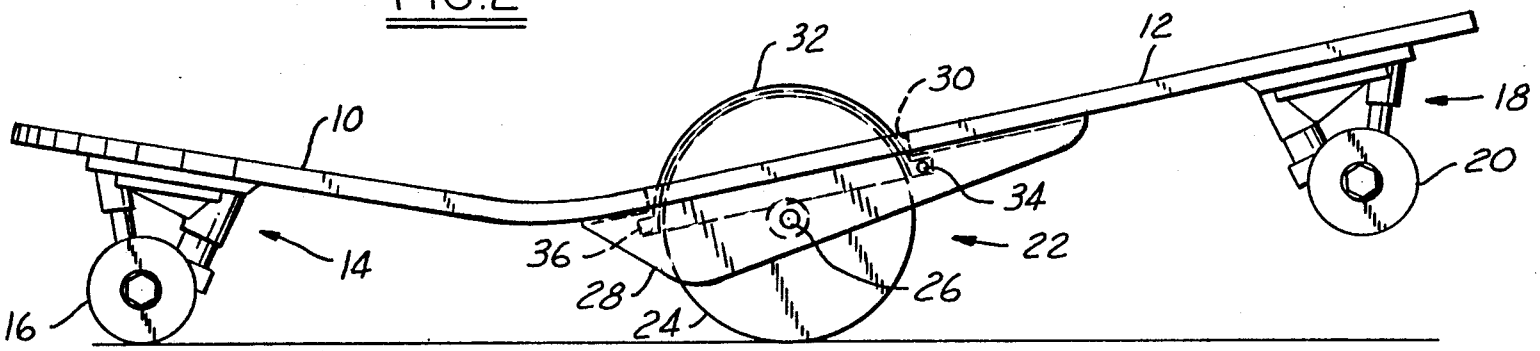
FIG. 2 is a side view of the skateboard of FIG. 1.

The skateboard is illustrated in FIG. 2 in its normal position, i.e., with the rear wheels 20 off the ground as a result of rider's center of gravity being located slightly forward of center axle 26. In this attitude, the rear wheels are effective only to prevent the board from tilting rearwardly to an excessive degree. In the illustrated attitude, this improved skateboard provides increased steerability and maneuverability relative to a conventional four-wheeled board, because of the greater ease with which the board can be tilted sideways to ride on the center wheel and only one of the two forward wheels 16. Alternatively, if the weight of the rider is shifted rearwardly slightly, the platform may be balanced in such fashion that it rolls on the center wheel alone, providing increased potential for turning or spinning. With a still greater rearward shift of the rider's weight, the board can be caused to balance on the center and one or both of the rear wheels 20.

Thus, it will be apparent that the five-wheel configuration of the illustrated skateboard provides a very substantial increase in the number of riding options available to the rider, providing additional challenge as well as pleasure.

While the illustrated configuration of the platform is generally V-shaped in side view, in conjunction with a center wheel of substantially increased diameter, it is to be understood that other configurations are possible without departing from the basic concept of a fifth wheel located generally in the central portion of the platform. The oversized center wheel provides the improved ridability and maneuverability described above, while providing, in conjunction with the central slot, a convenient arrangement for the brake mechanism. It need not, however, protrude through the platform. The upwardly-inclined front portion of the V-shaped platform helps to prevent the rider's foot from slipping off the platform during the time the rider is vigorously pushing off with the other foot.

This invention may be further developed within the scope of the following claims. Accordingly, the above specification is to be interpreted as illustrative of only a single operative embodiment of the present invention, rather than in a strictly limited sense.

I now claim:

1. A skateboard comprising:

a longitudinally extending platform having a front end, a rear end, and a central portion intermediate said ends, said platform providing a surface upon which a rider may stand;

a steerable front axle assembly mounted on said front end of said platform and including a pair of laterally spaced front wheels rotatably mounted on a front axle;

a steerable rear axle assembly mounted on said rear end of said platform and including a pair of laterally spaced rear wheels rotatably mounted on a rear axle;

a single central wheel rotatably mounted on a substantially fixed center axle secured to said central portion of said platform, said center wheel having a substantially larger diameter than said front and rear wheels, the placement and diameter of said center wheel being such that it is possible to ride solely on said center wheel, with said front and rear pairs of wheels out of contact with the skatboard-supporting ground surface on which said center wheel is rolling;

the ground-contacting portions of said pair of front wheels and said center wheel defining a first platform-supporting plane upon which the platform can roll when the center of gravity of a rider is positioned generally forwardly of said center axle, in which condition said pair of rear wheels is spaced above said first support plane and out of contact with the ground;

the ground-contacting portions of said pair of rear wheels and said center wheel defining a second platform-supporting plane upon which the platform can roll when the center of gravity of a rider is positioned generally rearwardly of said center axle, in which condition said pair of front wheels is spaced above said second support plane and out of contact with the ground;

the platform being steerable by the conventional steering method of lateral shifting of the weight of the rider while the skateboard is rolling forwardly or rearwardly and on either the first or second plane.

2. The skateboard of claim 1 wherein said platform is generally V-shaped when viewed from the side, whereby said front and rear ends are higher off the ground than is said central portion.

3. The skateboard of claim 1 wherein said central portion of said platform has a longitudinal slot through which a portion of said center wheel projects, so that a portion of said center wheel extends up through said slot and above said central portion of said platform.

4. The skateboard of claim 1 which further comprises brake means actuatable by the foot of a rider and adapted to frictionally engage said central wheel when weight is applied thereto by a rider.

5. The skateboard of claim 3 which further comprises brake means movably secured to said platform and positioned to be actuatable by the foot of a rider, said brake means being generally shaped as a fender covering the portion of said center wheel which extends up through said slot, said brake means being movable into frictional engagement with said center wheel to brake said wheel when actuated by a rider.

* * * * *